United States Patent [19]

Ljungbo

[11] 4,188,756

[45] Feb. 19, 1980

[54] HEAT-INSULATED PLASTIC HALL

[75] Inventor: Sven O. B. Ljungbo, Bålsta, Sweden

[73] Assignee: Erecta AG, Zug, Switzerland

[21] Appl. No.: 862,281

[22] Filed: Dec. 19, 1977

[30] Foreign Application Priority Data

Dec. 22, 1976 [SE] Sweden ..... 7614428
Sep. 27, 1977 [NO] Norway ..... 773307

[51] Int. Cl.[2] ..... E04B 1/34

[52] U.S. Cl. ..... 52/83; 52/2; 52/63

[58] Field of Search ..... 52/2, 63, 83, 404, 406; 428/192, 194, 116, 304, 310, 311, 71; 135/1 R; 160/DIG. 7

[56] References Cited

U.S. PATENT DOCUMENTS

| | | | |
|---|---|---|---|
| 365,966 | 7/1887 | Bryant | 428/192 |
| 2,495,636 | 1/1950 | Hoeltzel | 52/406 |
| 2,657,716 | 11/1953 | Ford | 52/2 |
| 2,698,020 | 12/1954 | Phane | 52/2 |
| 2,753,019 | 7/1956 | Phane | 52/2 |
| 3,277,615 | 10/1966 | Marquez | 52/2 |
| 3,854,253 | 12/1974 | Slowbe | 52/2 |
| 3,922,822 | 12/1975 | Mollinger | 52/63 |
| 3,973,364 | 8/1976 | Seaman | 52/83 |

FOREIGN PATENT DOCUMENTS

| | | | |
|---|---|---|---|
| 1354172 | 5/1974 | United Kingdom | 428/315 |

*Primary Examiner*—James A. Leppink
*Assistant Examiner*—Henry E. Raduazo
*Attorney, Agent, or Firm*—Lawrence E. Laubscher

[57] ABSTRACT

An air or frame supported hall made out of synthetic sheeting, especially a hall having an outer heat insulation consisting of a number of adjacent mats covering substantially the entire hall, each mat consisting of a core of soft cellular synthetic, each flat side of said core being laminated with an unreinforced soft flexible synthetic sheet material.

4 Claims, 7 Drawing Figures

FIG. 1a
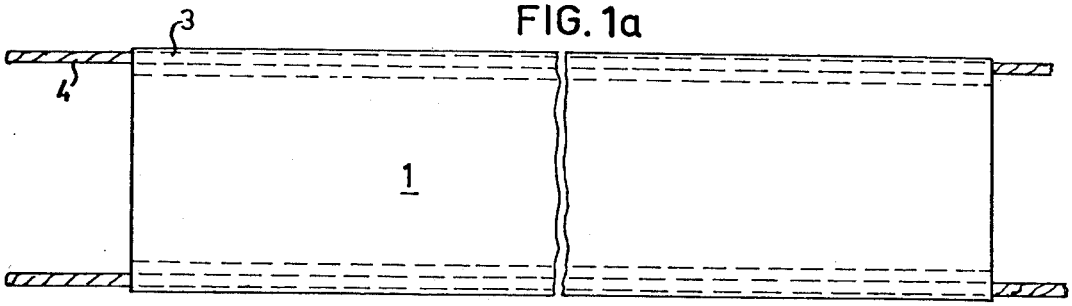
FIG. 2a
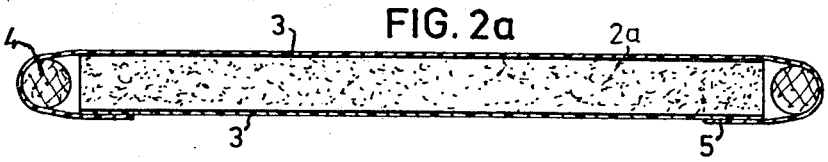
FIG. 1b
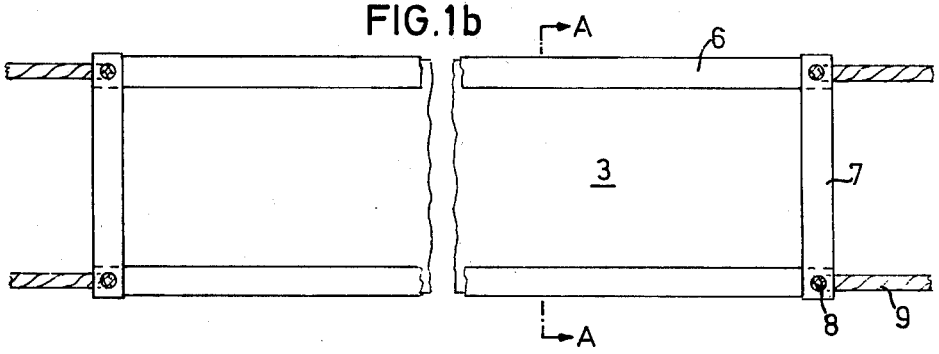
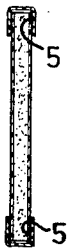
FIG. 2b
FIG. 1c
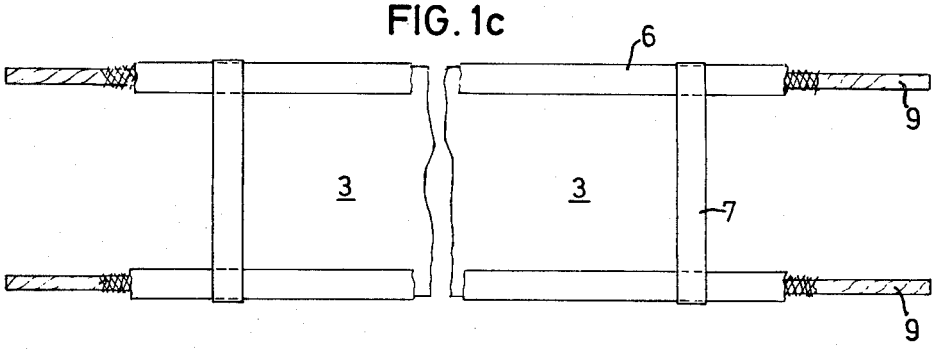

HEAT-INSULATED PLASTIC HALL

BRIEF DESCRIPTION OF THE PRIOR ART

The present invention relates to an air or frame-supported hall made out of plastic sheeting, especially a hall comprising an elongated portion having arched section. The invention also relates to a heat-insulating material for heat insulating such a hall.

Plastic halls are used during the winter as heated sports, meeting and storage premises. Due to the poor heat-insulation of the plastic sheeting, heat energy consumption is very great and leads to great costs.

In order to reduce the great heat energy costs, various attempts to heat-insulate the halls have been made. For example, a liquid plastic foam has been sprayed onto the outside of the hall and been allowed to harden to a rigid layer of cellular plastic. One disadvantage of this technique has been that the hall has thereafter not been able to be moved without destroying the insulation. Another disadvantage is that the insulation is easily damaged during storms.

Another known technique has consisted of attaching a second sheeting to several points on the inside of the hall so that the hall has become double-walled. In said technique, the inner sheeting has, for example, been attached to the hall in such a manner that the entire wall has been divided up into a number of compartments which, in some cases, have been able to be inflated with air of superatmospheric pressure so as to achieve the greatest possible thickness of the hall wall. In other instances, the two plastic sheetings have been provided with mutual spacers in the form of strips or wires. However, in these cases, the achieved heat-insulating effect has been relatively slight and insufficient.

SUMMARY OF THE INVENTION

The purpose of the present invention is to obtain insulated halls of the kind mentioned above by means of using heat insulation in the form of an easily assemblable and disassemblable system while achieving economical heating. According to the invention, this is achieved in halls of the kind mentioned above by means of their being provided with a heat insulation consisting of a number of adjacent lengths of approx. 5–50 mm thick and approx. 1–2 m wide cores of soft cellular plastic, said lengths essentially covering the entire hall. The flat sides of the cores are laminated with an unreinforced, soft, flexible synthetic plastic sheet material. Each such length is preferably provided with two linings or edge strips of reinforced synthetic plastic sheet material, said edge strips covering the longitudinal edges of the lengths and being glued or welded a distance in on the unreinforced synthetic plastic sheet material.

According to another embodiment of the invention, the lengths are designed so that the unreinforced sheets extend a distance beyond the edges of the cellular plastic and form grooves through which rope, preferably of plastic, runs. The ends of the rope are tied to the anchoring of the hall.

The lengths are arranged on the hall in a sufficient number so that essentially the entire surface of the plastic sheeting is covered. If the hall has specially-designed end sections in the form of, for example, caps or the like, the lengths can also be arranged over said sections in a manner so that said end sections are also covered.

Anchorage of the lengths is effected on the ground level at attachment points arranged around the hall. If anchorings or braces are lacking, they can be arranged by means of, for example, ground anchoring means, concrete blocks, sandbags, wooden frames, steel cable or the like. According to a further embodiment, the ends of the lengths can have reinforcements in the form of, for example, a reinforced plastic sheeting glued or welded about the length. Eyelets, for example, can be mounted onto said reinforced sections for attachment of the rope, by means of which the length can be tied onto the anchoring of the hall. The longitudinal linings or end strips can also extend a distance beyond the short ends of the lengths. These edge strip extensions can constitute attachment means for rope or the like or be tied directly to the anchoring of the hall.

The soft cellular plastic material used in the lengths can be of any optional known kind, for instance, the kind consisting of expanded polyurethane, polystyrene, polyethylene, polyester, epoxy, vinyl, rubber, latex or other synthetic resins. The density can lie between approx. 15–85 kg/m$^3$, preferably between 15–35 kg/m$^3$. The thickness of the cellular plastic core can lie between 5–50 mm, preferably between 8–25 mm, most suitably between 8–12 mm.

The plastic foil material used for lamination of the cellular plastic core is of the unreinforced, soft, flexible type of polyvinyl chloride, polyethylene, polyurethane or another known kind of flexible plastic sheet material. The thickness of the sheet should lie between 0.1–0.6 mm. If desired, a foil which is unreinforced and thinner than the foil which is to cover the upper side of the cellular plastic core and be subjected directly to weather and wind can be arranged on the side of the cellular plastic core which shall face the plastic screening of the hall. The sheet can be coloured in a known way, preferably in light-grey, dark green, yellow, brown and black colours.

The plastic sheet can be laminated to the cellular plastic core by means of using an adhesive layer of a suitable laminating glue, for example a PVC urethane glue. The non-thermoplastic cellular plastic fastens therewith so effectively to the sheet that it will function as reinforcement for the plastic, and it is thereby no longer necessary to use a woven fabric-reinforced plastic sheeting for surface covering of the cellular plastic core. However, the plastic sheet can also be laminated to the cellular plastic core in another manner, for example by means of welding in a known manner, flame lamination or the like. Of utmost importance is that adhesion between the sheet and the cellular plastic be so strong that the cellular plastic provides the same strength results as a woven fabric-reinforcement would have provided the plastic with. This entails that the sheet cannot be loosened from the cellular plastic without the cellular plastic or the sheet being torn apart, that is, they shall not be able to be separated in the seam itself.

By means of the laminated cellular plastic core provided with edge strips according to the invention, it is possible to replace more expensive woven plastic (plastic-impregnated canvas) as laminating material. Furthermore, the life-time of the hall increases by means of the underlying plastic hall sheeting being protected against weather and wind. The edge strip also has a stabilizing effect and holds the construction together in the event of storms.

BRIEF DESCRIPTION OF THE DRAWING

The invention is described in more detail below in connection with the enclosed drawings and some examples of embodiments.

FIG. 1 is a plan view of an insulation component formed in accordance with the present invention;

FIG. 2 is a sectional view taken along line 2—2 of FIG. 1;

FIG. 5 is a plan view of another embodiment of the invention; and FIGS. 6 and 7 are plan and side elevation views, respectively, of a building structure formed from the components of FIG. 1.

DETAILED DESCRIPTION

Figure 4:
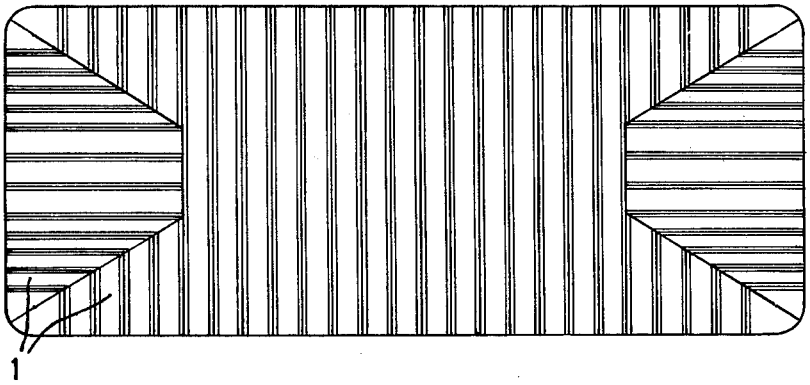
FIG. 4 is a sectional view taken along line 4—4 of FIG. 3.
Figure 3:
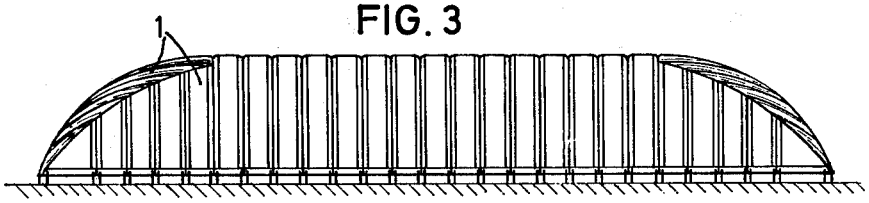
FIG. 3 is a plan view of a record embodiment of the invention.

Referring first more particularly to FIGS. 1 and 2, the insulation component 1 includes a cellular synthetic plastic core provided with reference numeral 2 and the synthetic plastic sheet laminated thereto with reference numeral 3. The plastic rope has reference numeral 4 and a glue or welding seam is indicated at reference numeral 5. In FIG. 2, one can see how the bottom side of the cellular plastic core has first been covered with a plastic sheet. The upper side has thereafter been covered with another similar plastic sheet which has been drawn a slight distance beyond the edge of the actual core so as to provide space for the rope. It has thereafter been glued to the synthetic plastic sheet on the bottom side of the cellular plastic core. FIG. 3 shows an embodiment in which the cellular plastic core has been laminated with unreinforced synthetic plastic sheet and in which strips 6 and 7 of reinforced plastic sheet have been welded around the side edges and end edges of the cellular plastic core. Eyelets 8 for the attachment of rope 9 are arranged in the corners. In FIG. 4, the welding of the reinforced sheet to the unreinforced sheet is shown at 5.

FIG. 5 shows another embodiment in which the edge strips have been cut a distance beyond the short ends of the length. Rope 9 is attached to the edge strips 6 in a suitable manner.

Referring now to FIGS. 6 and 7, the synthetic plastic hall is formed by lengths of the components 1 of FIG. 1, which lengths are anchored at the bottom of the hall by means of rope. The lengths covering the end sections are anchored to the lengths in the opposite end section by means of rope which runs under the lateral lengths. In FIG. 6 one can see that only the corner portions of the end sections are not covered by lengths. It is, however, possible to custom-make special lengths for these parts as well.

EXAMPLE 1

A cold-resistant, UV-stabilized, self-extinguishing soft PVC sheet of a thickness of 0.30 mm was laminated to both sides of a 12 mm thick and 135 mm wide web of polyurethane cellular plastic having a density of 28 kg/m$^3$ in the manner illustrated in FIG. 1. Lamination was carried out with a PVC-urethane glue (adhesive layer). The cellular plastic fastens thereto so effectively that it will function as reinforcement for the PVC sheet. This made the use of woven fabric-reinforced PVC sheeting as surface covering of the polyurethane cellular plastic core unnecessary.

All of the edges of the lengths were reinforced with 8 mm polypropylene line. Said line was hemmed in by means of heat gluing in the excess edge strip of PVC sheet.

24 similar lengths, 48 meters long and manufactured according to the above, were used for heat insulation of a plastic hall provided with a sheeting having a thermal conductivity (λ-value) of 0.025. If one were to overlook the insignificant improvement of the heat transfer coefficient (k-value) which the glued foils provided, the length as a whole had a k-value of (0.025.1/0.012)=2.08 2 kcal/m$^2$, h, ° C. When the lengths were laid onto the hall, whose sheeting had a k-value=6, the covered part of the hall had a k-value of $(1/\frac{1}{2}+1/6)=1.5$. The k-value for the covered part of the hall had, thus, been improved by a factor of 4 (from 6 to 1.5) in relation to the uncovered portion of the hall.

EXAMPLE 2

In this example, a 25 mm thick sheet of flame-proofed polyurethane foam having a density of 28 kg/m$^3$ was used as a cellular plastic core. The outside of the same was glued in the manner indicated in FIG. 3 having a 0.20 mm thick, soft PVC sheet on the bottom side and a 0.40 mm thick, soft PVC sheet on the upper side. The thick sheet overlapped the thinner sheet in the seam 5. The rope in this case was 12 mm thick.

The lengths thusly obtained were used for heat insulation in the same manner as in example 1. However, the lengths were allowed to overlap each other within the area of the ropes. An improvement of heat insulation of the same magnitude as in example 1 was achieved.

EXAMPLE 3

Both of the flat surfaces of a 25 mm thick and 1.5 m. wide sheet of flame-proofed polyurethane foam having a density of 28 kg/m$^3$ were flame laminated with a 0.25 mm thick PVC sheet. The surface of the PVC-sheet which abuts the foamed plastic core had previously been laminated with a thin fibre sheet of cellulose fibres, glued with an approximately 20% acrylate resin compatible with PVC.

A 12 cm wide strip of woven fabric-reinforced PVC was folded around the edges of the finished laminate and welded onto the PVC-sheet of the laminate as revealed in FIG. 4. The woven fabric in the reinforced PVC-foil was of the Panama type and consisted of polyester yarn. The strip had a tensile stength of approx. 1000 kp.

A similar strip was welded around the end edges of said mat in the same manner as shown in FIG. 3 so that the entire foamed plastic core was enclosed in reinforced or unreinforced PVC-sheet. Eyelets were arranged in the corners for the attachment of the ropes with which the mat was tied to the anchoring of the hall.

What I claim is:

1. A heat insulation component adapted for use in constructing the exterior surface of a building, such as a hall, comprising (a) a generally rectangular soft cellular synthetic plastic core member (2) having a pair of opposed generally flat parallel top and bottom surfaces, said core member having a thickness of from about 5 to about 50 mm and a width of from about 1 to about 2 meters;

(b) a pair of first sheets (3) of unreinforced soft flexible synthetic plastic material bonded to said top and bottom core surfaces; and (c) pairs of second (6) and third (7) synthetic plastic reinforcement sheets extending around the longitudinal and end edge portions of said core member, respectively, said second and third sheets being bonded to said first sheets, said second sheets (6) being spaced from the longitudinal edges of said core member to define rope-receiving passages extending the length of the component.

2. A building construction including an elongated portion having arched sections, said building construction being formed from a plurality of heat insulating components each including (a) a generally rectangular soft cellular synthetic plastic core member (2) having a pair of opposed generally flat parallel top and bottom surfaces, said core member having a thickness of from about 5 to about 50 mm and a width of from about 1 to about 2 meters;

(b) a pair of first sheets (3) of unreinforced soft flexible synthetic plastic material bonded to said top and bottom core surfaces; and (c) pairs of second (6) and third (7) synthetic plastic reinforcement sheets extending around the longitudinal and end edge portions of said core member, respectively, said second and third sheets being bonded to said first sheets, said second sheets (6) being spaced from the longitudinal edges of said core member to define rope-receiving passages extending the length of the component.

3. A building construction including an elongated portion having arched sections, said building construction being formed from a plurality of heat insulating components each including (a) a generally rectangular soft cellular synthetic plastic core member (2) having a pair of opposed generally flat parallel top and bottom surfaces, said core member having a thickness of from about 5 to about 50 mm and a width of from about 1 to about 2 meters;

(b) a pair of unreinforced soft flexible synthetic plastic sheets (3) bonded to the top and bottom surfaces of said core member; and (c) a pair of longitudinal edge reinforcing strips (6) formed of reinforced synthetic plastic sheet material, said edge reinforcing strips being bonded to the external surfaces of the corresponding edge portion of said sheets.

4. Apparatus as defined in claim 3, and further including a pair of end edge reinforcing strips (7) formed of reinforced synthetic plastic sheet material, said end edge reinforcing strips being folded across the end edges of the component and being bonded to the external surfaces of the corresponding edge portions of said sheets; and further including attachment means for connecting ropes (9) with the four corners of the component.

* * * * *